United States Patent [19]

Reichle et al.

[11] Patent Number: 4,621,746

[45] Date of Patent: Nov. 11, 1986

[54] VENDING APPARATUS

[76] Inventors: Gregory C. Reichle, 1020 Troost Ave.; Bruce H. Leeseberg, 1015 Troost Ave., both of, Forest Park, Ill. 60130

[21] Appl. No.: 650,354

[22] Filed: Sep. 13, 1984

[51] Int. Cl.[4] ..... G07F 11/54

[52] U.S. Cl. ..... 221/76; 221/83; 221/86; 221/91; 221/197; 211/58; 211/131; 74/416

[58] Field of Search ..... 194/2; 221/76, 83, 86, 221/79, 81, 89, 91, 197, 155, 242; 74/142, 416; 248/158; 211/47, 48, 58, 78, 131

[56] References Cited

U.S. PATENT DOCUMENTS

| | | | |
|---|---|---|---|
| 766,716 | 8/1904 | MacKenzie . | |
| 1,116,599 | 11/1914 | Madsen . | |
| 1,139,248 | 5/1915 | Winkelmeyer | 221/81 |
| 1,645,442 | 10/1927 | Meyer . | |
| 1,885,324 | 11/1932 | Bjornson | 221/83 |
| 2,524,877 | 10/1950 | Bergman | 211/78 X |
| 2,533,623 | 12/1950 | Ransom . | |
| 3,235,093 | 2/1966 | Eisbart et al. | 211/47 |
| 3,648,659 | 3/1972 | Jones | 248/158 X |
| 4,030,608 | 6/1977 | Howard | 211/78 X |
| 4,146,150 | 3/1979 | Low et al. | 221/89 |
| 4,381,059 | 4/1983 | Schurman | 221/91 X |

FOREIGN PATENT DOCUMENTS

| | | | |
|---|---|---|---|
| 479922 | 11/1969 | Switzerland . | |
| 200936 | 2/1967 | U.S.S.R. | 221/76 |

*Primary Examiner*—Joseph J. Rolla
*Assistant Examiner*—Edward S. Ammeen
*Attorney, Agent, or Firm*—Willian Brinks Olds Hofer Gilson & Lione Ltd.

[57] ABSTRACT

An improved apparatus for vending newspapers or similar articles is disclosed. The apparatus consists of a horizontally disposed drum mounted on a pedestal. The drum includes an open top and a sliding door on its vertical face. A drive plate is rotatably mounted in the bottom of the drum, and a carousel is detachably secured to the drive plate for rotation therewith. The carousel includes a plurality of open-ended, radial slots. The slots are formed by vertical walls extending from the center of the carousel to the periphery of the carousel. The upper edges of the walls slope downwardly from the center of the carousel to the periphery of the carousel. Various carousels having the same structure but different size slots may be used in a machine. A clear plastic dome is used to cover the open top of the drum. A lock and key arrangement is provided so that the dome may be secured to the drum and easily removed. A coin-activated lever advancing system is provided to rotate the carousel one slot at a time and to simultaneously open the sliding door. The carousel rotating mechanism includes the advancing lever, gears, a ratchet, springs, and a conventional coin-activating mechanism. The door is opened by the lever in combination with the pulley system. Return springs are used to close the door when the lever system is not activated.

13 Claims, 5 Drawing Figures

FIG. 1
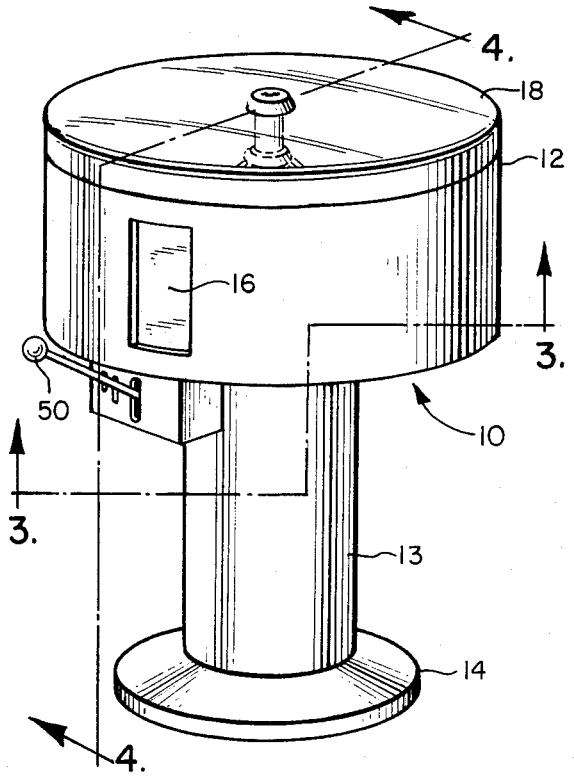
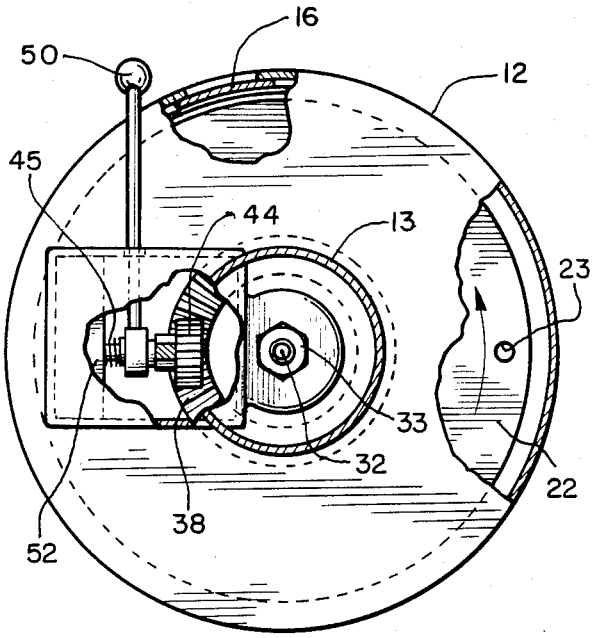
FIG. 3
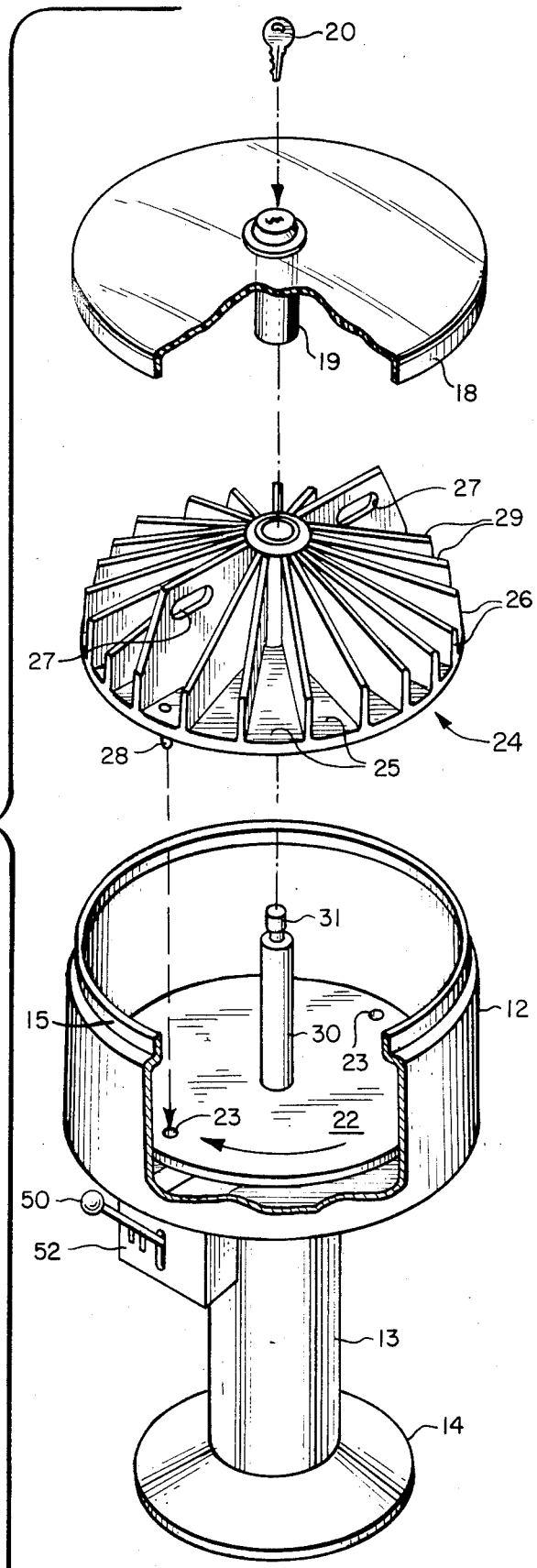
FIG. 2

FIG. 4
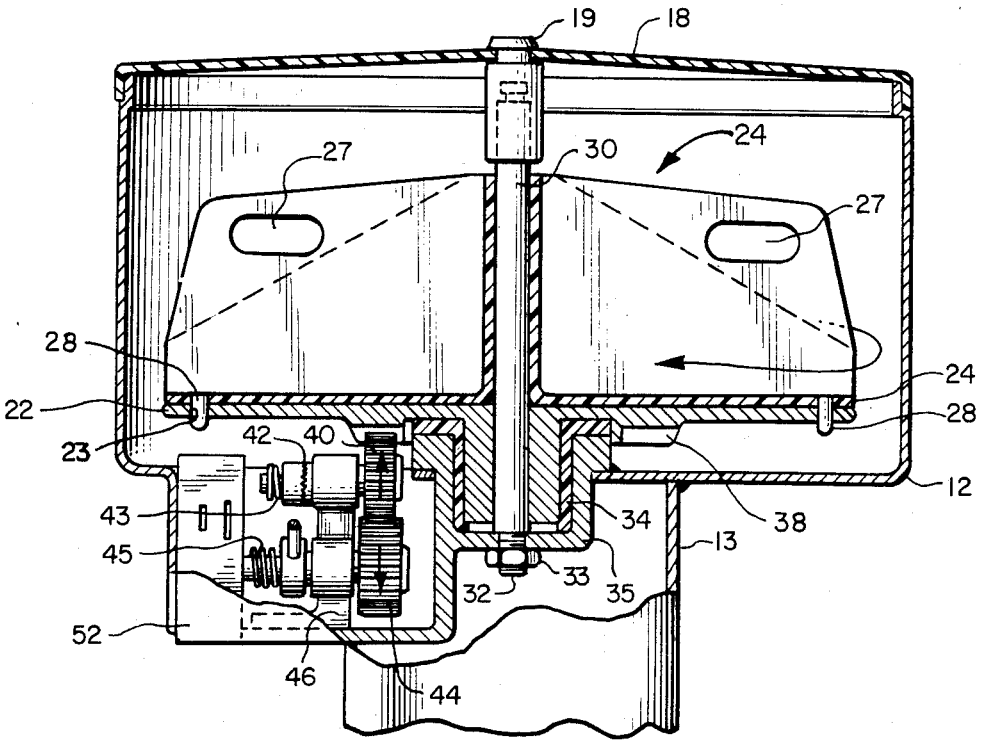
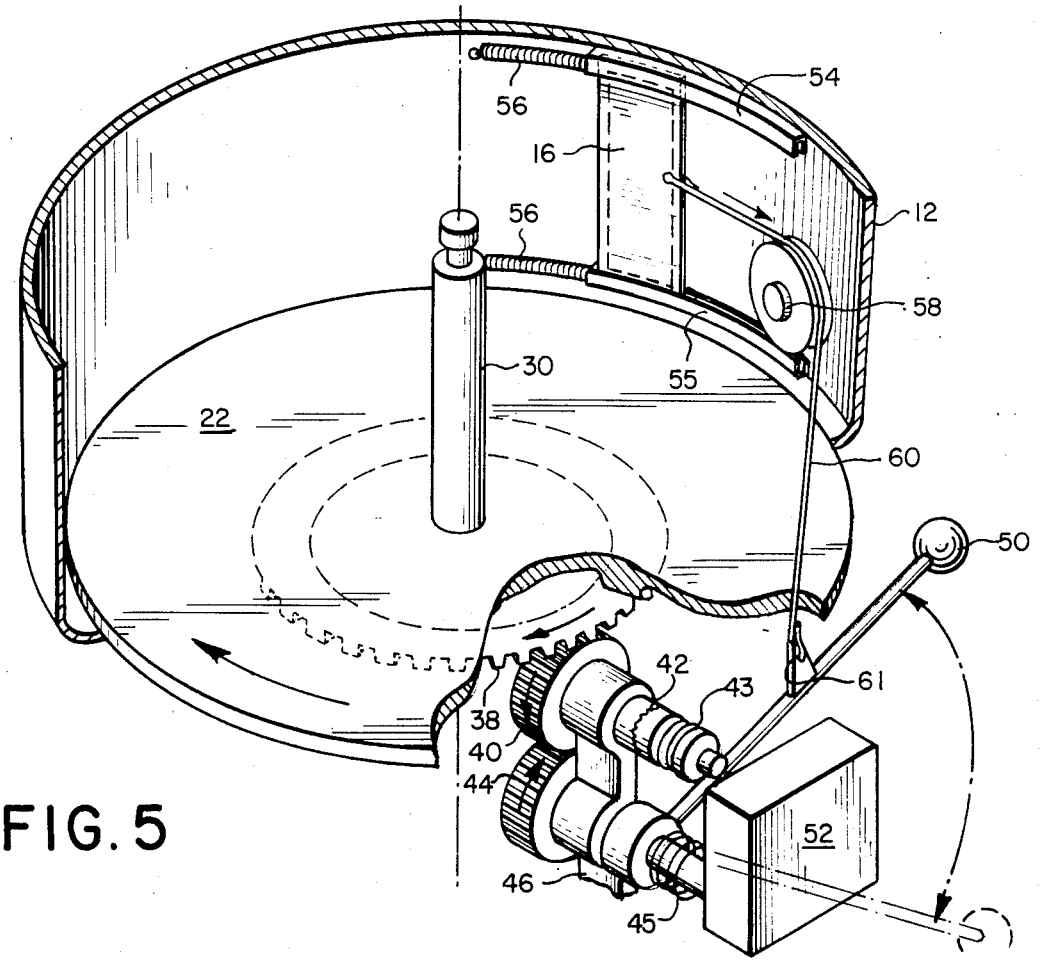
FIG. 5

VENDING APPARATUS

BACKGROUND OF THE INVENTION

The present invention relates to an apparatus for vending articles, and in particular to an improved newspaper vending machine.

Most conventional newspaper vending machines consist of a single cubic cavity for holding a plurality of newspapers. A person purchases a newspaper from such a machine by inserting the appropriate coins into the machine and thereby gaining access to the newspaper-holding cavity. The purchaser then removes a newpaper.

However, once access is gained to the newspaper-holding cavity, a person may also remove additional newspapers which were not paid for. This form of theft or pilfering can add up to significant losses for a newspaper vendor.

Several different approaches have been taken to design a vending machine that prevents this kind of pilfering of newspapers and other articles. For example, U.S. Pat. No. 1,645,442 (Meyer) discloses a newspaper vending machine consisting of a vertically disposed drum rotatably mounted on a horizontal axis. This drum includes a plurality of radial pockets open at their outer ends. The pockets are filled with a newspaper when they are in an upright position. When a pocket is in a downwardly inclined position, the newspaper will slide, under the force of gravity, from the pocket and through outer end of the drum, via a chute, to the purchaser. The drum is rotated by a lever which is activated by a coin controlled mechanism.

While the Meyer vending machine is designed to prevent newspaper theft, it has some shortcomings. First, newspapers must be loaded in this machine one-at-a-time at the situs of the machine. Thus, it take significantly longer for a newspaper deliveryman to load several Meyer machines than to load the same number of conventional single-cavity vending machines. The cost of the additional labor needed to load the Meyer machines may greatly outweigh the potential pilfering losses that may be incurred with single-cavity machines. Second, the purchaser must stoop close to the ground to pick up the purchased newspaper since this machine is a gravity-based system. Third, the coin-controlled drum-advancing mechanism of the Meyer machine is not well suited for versatility. The mechanism includes a separate coin slot for each pocket. The size of the coin slot corresponds to the size of the coins needed to activate the machine. Thus, every time the price of the newspaper is changed, the size of every coin slot must be changed.

Another type of vending machine that permits only the purchased article to be removed from the machine is disclosed in U.S. Pat. No. 1,116,599 (Madsen). The Madsen machine includes a plurality of radial compartments on a horizontally disposed disk. The compartments are open at the ends and are accessible through a sliding door on the vertical face of a cylinder enclosing the disk. The cylinder is provided with a glass lid to disclose the contents of the compartments. An elaborate pull rod system is provided for imparting intermittent movement to the disk whereby compartments are brought successively in juxtaposition with the door opening. The purchaser may bring any compartment into alignment with the door by successively pulling and releasing the pull rod. When it is desired to remove a commodity from the compartment juxtaposed to the sliding door, a coin is inserted into a mechanism which unlocks the door.

The Madsen machine is obviously intended for vending a plurality of different articles rather than a plurality of identical newspapers. Thus, there would be some drawbacks in adapting a Madsen machine for vending newspapers. First, the rotating disk of this machine is not readily removable. Thus, like the Meyer machine, newspapers would have to be loaded into this machine one-at-a-time at the situs of the machine. Second, since newspapers on any given day are identical, there is no need for a mechanism that will allow any compartment to be brought in juxtaposition with the sliding door. A simpler device will suffice.

SUMMARY OF THE INVENTION

The present invention is directed to an improved apparatus for vending newspapers or similar articles.

According to this invention, a horizontally disposed housing is provided with an open top and a sliding door on its vertical face. A removable carousel is rotatably mounted in the housing. The carousel is provided with a plurality of open-ended radial slots for holding articles such as newspapers. A removable cover is placed over the top of the housing, and means are provided for rotating the carousel in increments corresponding to the angular displacement of one slot and for opening and closing the sliding door.

In the preferred embodiment of the invention, a drum-shaped housing is horizontally mounted on a pedestal. The carousel is detachably secured to a drive plate rotatably mounted in the bottom of the drum. The carousel slots are formed by vertical walls on the carousel that slope downwardly from the center of the carousel to the periphery of the carousel. The number of slots on the carousel can be varied to accommodate newspapers of different sizes. At least two handles are connected to the walls of the carousel. The rotating means includes a coin-actuated lever, gears and a ratchet that cooperate with lugs on the drive plate to rotate the drive plate when the lever is depressed. The sliding door is also opened via a pulley system when the lever is depressed, and is closed by a spring means when the lever is released.

The present invention provides important advantages in vending newspapers one-at-a-time (to prevent pilfering) that is not available with prior vending machines. First, the carousel of the present invention is removable and can be used in any vending machine of the present invention. Thus, many carousels can be loaded at a remote location, such as the newspaper printing plant or central distribution station, and the loaded carousels can then be quickly placed into vending machines. The empty carousels can be brought back to the plant for reloading.

The removable carousel of the present invention is thus designed to solve the problem of pilfering without increasing the labor necessary to load the vending machines. The removability feature is also enhanced by the addition of handles to the carousels and an easily removable cover. Moreover, the labor-saving advantage of the removable carousel can be further exploited by developing a system for automatically loading the carousels at the printing plant.

Another benefit of the present invention is that the carousels with different sized slots can be used in the same machine. Thus, a vending machine can be readily adapted for different size papers merely by using carousels with different size slots.

The carousel advancing means and door opening means of the present invention also provide benefits over prior mechanisms due to their simplicity. These mechanisms are easy to make and service and, therefore, less expensive and more desirable.

The invention itself, together with further objects and attendant advantages, will be best understood by reference to the following detailed description taken in conjunction with the drawings.

BRIEF DESCRIPTION OF THE DRAWINGS

FIG. 1 is a perspective view of a newspaper vending machine embodying the present invention.

FIG. 2 is an exploded perspective view of a newspaper vending machine embodying the present invention.

FIG. 3 is a sectional view taken along lines 3—3 of FIG. 1.

FIG. 4 is a sectional view taken along lines 4—4 of FIG. 1.

FIG. 5 shows the elements of the preferred carousel rotating means and door opening and closing means of the present invention.

DETAILED DESCRIPTION OF A PREFERRED EMBODIMENT

Referring now to the drawings, FIG. 1 shows the outer structure of a newspaper vending machine 10 made in accordance with the present invention. The machine includes a drum-shaped housing 12 horizontally mounted on a pedestal 13. The pedestal 13 is connected to or integral with a pedestal base 14. The base 14 may be provided with holes (not shown) so that it may be bolted to a concrete sidewalk.

The drum 12 includes a sliding door 16 on its vertical face and an open top defined by a rim 15. The open top is covered by a transparent enclosure or dome 18. The dome 18 does not have to be literally transparent, but it should be sufficiently clear so that a person can see through it to view the contents of the drum 12.

Referring now to FIGS. 2 and 4, the dome 18 is provided with a lock 19 which can be readily locked or opened with a matching key 20. The lock 19 clamps to the notched top 31 of a vertically disposed shaft 30 in the drum 12. Thus, the lock 19 serves to secure the dome 18 to the drum 12 via the shaft 30, but is easily removed from the drum.

A metal drive plate 22 is mounted on the vertical shaft 30 in the bottom of the drum 12. A support housing 35 is provided in the bottom of the drum 12 for positioning and stabilizing the shaft 30 and the drive plate 22. The threaded end 32 of the shaft 30 protrudes through the bottom of the housing 35 and is secured thereto with a nut 33. A thrust and radial bearing 34 is positioned between the housing 35 and drive plate 22 to allow rotation of the shaft 30 and drive plate 22 within the drum 12.

A carousel 24 is detachably mounted on the drive plate 22. The bottom of the carousel 24 is equipped with two drive pins 28 which sit in the alignment holes 23 of the drive plate 22. Thus, when the drive plate 22 is rotated, the carousel is rotated with it. The drive pins 28 are the only means of securing the carousel 24 to the drive plate 22. Thus, the carousel 24 is easily loaded into and removed from the drive plate 22.

The carousel 24 is provided with a plurality of open-ended radial slots 25. These slots or compartments are formed by vertical walls or partitions 26 which extend from the center of the carousel to the periphery of the carousel. The upper edges 29 of the walls 26 slope downwardly from the center of the carousel 24 to its outer periphery. The sloped walls 26 are intended to make it easier for a person to remove a newspaper from a slot 25. Two of the walls of the carousel are provided with handles 27. In the embodiment shown in FIG. 2, these handles 27 are integral with two of the walls 26. However, it should be understood that other types of handles can be readily connected to the walls 26.

Each slot 25 of the carousel 24 is intended to hold one newspaper. The size of the slots 25 can be varied to accommodate different size newspapers. For example, one carousel may have 40 slots for a daily edition paper and another carousel may have 25 slots for a thicker Sunday edition paper. Except for the size and number of the slots, the carousels should be structurally identical. Thus, carousels with different size slots may be used in the same newspaper vending machine 10.

The alignment holes 23 and the drive pins 28 are positioned on the drive plate 22 and the carousel 24, respectively, so that one slot 25 of the carousel 24 will register in juxtaposition with the opening covered by the sliding door 16 when the carousel 24 is mounted on the drive plate 22. This opening is shown in FIG. 5 by the dashed lines inside the sliding door 16.

Referring now to FIGS. 3–5, the means for rotating the drive plate 22 and opening and closing the sliding door 16 will now be described. The underside of the drive plate 22 is provided with circumferentially disposed, vertically extending lugs or gear teeth 38. These lugs 38 intermesh with an upper drive gear 40, which is driven by a lower drive gear 44. These drive gears are mounted on a bracket 46 which is fastened in a conventional manner to the support housing 35. The lower drive gear 44 is connected directly to an advancing lever 50. The advancing lever 50 is biased in a normally upright position by a torsional spring 45, and is activated by a conventional mechanism contained in a conventional coin box 52 attached to the support housing 35. The upper drive gear 40 is connected to a ratchet 42 and a ratchet spring 43 so that it will only rotate forward when the advancing lever 50 is depressed and will not rotate backwards when the lever is released. The part of the coin box 52 that collects the deposited coins is preferably removable.

The gear ratios of the upper drive gear 40, lower drive gear 44 and drive plate lugs 38 are set so that when the advancing lever 50 is depressed, the drive plate 22 will rotate an increment corresponding to the angular displacement of one slot 25 of the carousel 24. Thus, the slot 25 adjacent the sliding door 16, which contains a newspaper, will come to register juxtaposed to the opening covered by the sliding door 16.

One skilled in the art could readily provide a coin-activating mechanism for the coin box 52 that allows the advancing lever 50 to be depressed to different positions depending on the number and type of coins inserted into the coin box. For example, if a daily edition newspaper costs twenty-five cents, the coin-activating mechanism would only allow the advancing lever to be depressed an arc of 90° when twenty-five cents was inserted to the coin box 52. This would cause the drive gears 40 and 44 to rotate the drive plate 22 and carousel 24 the angular displacement corresponding to the slot 25 provided for a daily edition newspaper. If fifty cents, the cost of a Sunday edition newspaper, were inserted into the coin box 52, the coin activating mechanism would allow the advancing lever 50 to be depressed an arc of 120°. This would cause the drive plate 22 and carousel 24 to rotate the angular displacement corresponding to the larger size slot 25 provided for a Sunday edition newspaper.

The sliding door 16 is mounted on the inner vertical face of the drum 12 between an upper guide track 54 and a lower guide track 55. One end of the sliding door 16 is connected to a loop 61 on the advancing lever 50 via a cable 60 and pulley wheel 58. The pulley wheel 58 is mounted on the inner vertical face of the drum 12. The sliding door 16 is biased in a normally closed position by return springs 56. The sliding door should also be provided with a lock (not shown) that will be locked when the sliding door 16 is closed an unlocked when the advancing lever 50 is depressed. Such a lock can be readily devised by one skilled in the art.

It is preferred that the drum 12, pedestal 13 and base 14 be made of thick A.B.S. plastic to provide weight and strength. The pedestal 13 is preferably hollow and filled with concrete, sand or other suitable filler material for weight and balance. The dome 18 is preferably made of clear lexan plastic and the carousel 24 of polystyrene plastic. Of course, it is contemplated that other materials can be substituted for the foregoing materials by those skilled in the art.

The preferred newspaper vending machine 10 embodying the present invention and depicted in the attached drawings operates in the following manner. When a purchaser inserts a coin in the coin box 52, a conventional coin-activating mechanism unlocks the advancing lever 50 and the sliding door 16. The purchaser then depresses and holds the advancing lever 50 against the force of the torsional spring 45, thereby turning the lower drive gear 44 in a clockwise direction as shown in FIG. 5. The lower drive gear 44 rotates the upper drive gear 40 in a counter-clockwise direction, which rotates the lugs 38, drive plate 22 and carousel 24 in a clockwise direction.

When the advancing lever 50 is depressed, it also opens the sliding door 16 via the cable 60 and pulley 58 against the bias of the return springs 56.

When the advancing lever 50 reaches the end of its arc of travel, the carousel 24 will have rotated an angular displacement corresponding to one slot. The slot, which was previously adjacent the sliding door 16 and holding a newspaper, will now be juxtaposed to the opening uncovered by the sliding door 16. The purchaser may then remove the contents of the slot.

When the purchaser releases the advancing lever 50, the torsional spring 45 will return it to its normally upright position. At the same time, the return springs 56 will bring the sliding door 16 back to its normally closed position. A lock will then lock the door 16 and lever 50 so that no one can reach inside the drum 12 and tamper with its contents. The ratchet 42 prevents the upper drive gear 40, and thereby the drive plate 22, from rotating backwards when the advancing lever 50 is released. The advancing lever 50 will remain locked in its upright position until the appropriate coins are inserted into the coin box again.

When all the articles in a carousel have been sold, or a new edition of a newspaper is to be sold, the carousel 24 may be easily removed from the drum 12. The dome 18 is unlocked by the key 20 and removed from the top of the drum 12. The carousel may then be lifted off the drive plate 22 using the handles 27. A newly loaded carousel may then be mounted on the drive plate by inserting the drive pins 28 into the alignment holes 23. The dome 18 is then placed over the top of the drum 12 and locked to the top 31 of the shaft 30. The vending machine 10 is then ready to sell more articles.

It should be apparent from the foregoing that the newspaper vending machine 10 of the present invention prevents pilfering of newspapers by only vending one newspaper at a time but does not have to be loaded at the situs of the machine. A carousel 24 can be easily removed and reloaded into the drum, and carousels with various slot sizes may be used with the machine. Furthermore, the carousel advancing mechanism and the door opening and closing mechanisms of the present invention are simple in their construction and operation.

It will be appreciated that various changes and modifications to the above-described embodiment can be made without departing from the spirit and scope of the present invention. For example, various combinations of coin-activated mechanisms and a removable coin box could be adapted to the present invention to permit the carousel 24 to be incrementally rotated one slot at a time. Also, the drive plate 22 could be omitted or made integral with the carousel 24 so that the lugs 38 would be connected to the underside of carousel 24. The carousel 24 would then be mounted directly on the shaft 30 and in the thrust and radial bearings 34 in the bottom of the drum 12.

It should be understood that various changes and modifications to the present embodiment disclosed herein will be apparent to those skilled in the art. Such changes and mofifications can be made without departing from the spirit and scope of the present invention and without diminishing its attendant advantages. It is, therefore, intended that the foregoing detailed description be regarded as illustrative rather than limiting, and that it be understood that it is the following claims, including all equivalents, which are intended to define the scope of this invention.

We claim:

1. An apparatus for vending articles comprising:

a horizontally disposed housing including an open top and a sliding door on its vertical face;

a removable carousel rotatably mounted in said housing, said carousel provided with a plurality of open-ended radial compartments for holding articles;

a removable enclosure for covering the top of said housing;

means for rotating said carousel in increments corresponding to the angular displacement of one compartment; and means for opening and closing said sliding door including a coin-activated lever;

a pulley wheel rotatably mounted on the inner vertical face of said housing;

means connected to the sliding door and lever via said pulley wheel for opening said sliding door when said lever is depressed; and means for closing said sliding door when said lever is not depressed.

2. The invention of claim 1 further comprising at least two handles connected to said carousel.

3. An apparatus for vending newspapers comprising:

a horizontally disposed housing including an open top and a sliding door on its vertical side;

a removable carousel rotatably mounted in said housing, said carousel provided with a plurality of open-ended, radial compartments for holding newspapers;

a removable cover for the top of said housing;

means for rotating said carousel in increments corresponding to the angular displacement of one compartment; and means for opening and closing said sliding door including a coin-activated lever;

a pulley wheel rotatably mounted on the inner vertical face of said housing;

means connected to the sliding door and lever via said pulley wheel for opening said sliding door when said lever is depressed; and means for closing said sliding door when said lever is not depressed.

4. The invention of claim 3 further comprising at least two handles connected to said carousel.

5. The invention of claim 3 wherein the compartments of said carousel are formed by vertically extending partitions radially mounted on said carousel, the upper edges of said partitions sloping downwardly from the center of said carousel to the outer periphery of said carousel.

6. The invention of claim 3 wherein more than one removable carousel can be used in the apparatus, and said carousels can have different numbers of radial compartments.

7. An apparatus for vending newspapers comprising:

a pedestal;

a drum horizontally mounted on said pedestal, said drum including an open top and a sliding door on its vertical face;

a drive plate rotatably mounted in the bottom of said drum;

a carousel provided with a plurality of open-ended radial slots for holding newspapers, said carousel being detachably secured to said drive plate for rotation therewith;

a handle connected to said carousel;

a detachable, transparent dome for covering the top of said drum;

means for rotating said carousel in increments corresponding to the angular displacement of one slot, said rotating means including a coin-activated lever, a spring for biasing said lever in a normally upright position, a plurality of gears and a ratchet connected to said lever, and a plurality of circumferentially disposed lugs provided on the bottom of said drive plate for engagement with one of said gears, whereby said lever, gears and lugs cooperate to rotate said drive plate in increments corresponding to the angular displacement of one slot when said lever is depressed; and means for opening and closing the sliding door including a pulley wheel rotatably mounted on the inner, vertical face of said drum;

means connected between said sliding door and said lever via said pulley wheel to open said sliding door when said lever is depressed; and spring means for closing said sliding door when said lever is not depressed.

8. The invention of claim 7 wherein said pedestal is hollow and contains a filler material for stability.

9. The invention of claim 7 wherein the slots of said carousel are formed by vertical walls extending from the center of said carousel to the periphery of said carousel, the upper edges of said walls sloping downwardly from the center of said carousel to the periphery of said carousel.

10. The invention of claim 9 wherein two handles are formed integral with two of said walls.

11. The invention of claim 7 wherein more than one carousel can be used in the apparatus, and said carousels can have different numbers of radial slots.

12. The invention of claim 7 wherein said dome is provided with a lock that secures said dome to said drum and that may be opened with a matching key.

13. An apparatus for vending newspapers comprising:

a horizontally disposed housing including an open top and a sliding door on its vertical side;

a removable carousel rotatably mounted in said housing, said carousel provided with a plurality of open-ended, radial compartments for holding newspapers;

a removable cover for the top of said housing;

means for rotating said carousel in increments corresponding to the angular displacement of one compartment;

said rotating means including a coin-activated lever, a spring for biasing said lever in a normally upright position, a plurality of gears and a ratchet connected to said lever, and a plurality of circumferentially disposed gear teeth connected to the underside of said carousel for engagement with said gears, whereby said lever, gears and carousel gear teeth cooperate to rotate said carousel in increments corresponding to the angular displacement of one compartment when said lever is depressed;

a pulley wheel rotatably mounted on the inner vertical face of said housing;

means connected to the sliding door and lever via said pulley for opening said sliding door when said lever is depressed; and means for closing said sliding door when said lever is not depressed.

* * * * *